US008241017B2

(12) United States Patent
Yamamoto et al.

(10) Patent No.: US 8,241,017 B2
(45) Date of Patent: Aug. 14, 2012

(54) CEILING FAN

(75) Inventors: Kiminobu Yamamoto, Aichi (JP); Tetsuji Kawazu, Aichi (JP); Hiroshi Yoshikawa, Aichi (JP); Kiyohiko Iwamoto, Aichi (JP); Yoshiki Tanimura, Aichi (JP)

(73) Assignee: Panasonic Corporation, Osaka (JP)

( * ) Notice: Subject to any disclaimer, the term of this patent is extended or adjusted under 35 U.S.C. 154(b) by 624 days.

(21) Appl. No.: 12/514,349

(22) PCT Filed: Sep. 26, 2007

(86) PCT No.: PCT/JP2007/068604

§ 371 (c)(1),
(2), (4) Date: May 11, 2009

(87) PCT Pub. No.: WO2008/059665

PCT Pub. Date: May 22, 2008

(65) Prior Publication Data

US 2010/0040494 A1 Feb. 18, 2010

(30) Foreign Application Priority Data

Nov. 13, 2006 (JP) ..... 2006-306357
Nov. 17, 2006 (JP) ..... 2006-311188

(51) Int. Cl.
*F04B 35/04* (2006.01)

(52) U.S. Cl. ..... 417/423.1

(58) Field of Classification Search ..... 417/423.1, 417/423.7, 423.12, 424.1
See application file for complete search history.

(56) References Cited

U.S. PATENT DOCUMENTS

| | | | | |
|---|---|---|---|---|
| 4,073,598 | A * | 2/1978 | Mizutani et al. | 416/5 |
| 4,515,538 | A * | 5/1985 | Shih | 417/572 |
| 2002/0119057 | A1 * | 8/2002 | Sekihara et al. | 417/415 |
| 2004/0247427 | A1 | 12/2004 | Chen | |

FOREIGN PATENT DOCUMENTS

| | | |
|---|---|---|
| JP | 56-41115 | 9/1981 |
| JP | 56-163696 | 12/1981 |
| JP | 62-243990 | 10/1987 |
| JP | 63-164596 | 10/1988 |
| JP | 5-157092 | 6/1993 |
| JP | 3032325 | 4/2000 |

OTHER PUBLICATIONS

International Search Report issued Dec. 4, 2007 in the International (PCT) Application of which the present application is the U.S. National Stage.

* cited by examiner

*Primary Examiner* — Anh Mai
*Assistant Examiner* — Andrew Coughlin
(74) *Attorney, Agent, or Firm* — Wenderoth, Lind & Ponack, LLP.

(57) ABSTRACT

A ceiling fan includes a motor for rotating multiple blades. This motor includes a hollow shaft that is disposed upright on the center of a disc-like stator, and a rotor around an outer periphery of the stator. The rotor integrally rotates with the blades. This motor further includes a cylindrical bearing housing, and a pair of ball bearings including an upper ball bearing and a lower ball bearing housed in this bearing housing. This bearing housing has a base in its center. The upper ball bearing is disposed over the base, and the lower ball bearing is disposed under the base in this bearing housing. Both bearings are fixed onto the hollow shaft.

11 Claims, 12 Drawing Sheets

CEILING FAN

TECHNICAL FIELD

The present invention relates to ceiling fans connected to a hollow shaft protruding upward from a motor that rotates blades, and a pipe suspending from the ceiling.

BACKGROUND ART

One known technology to prevent drop accidents due to loosened or detached screws in this type of conventional ceiling fans is to sound an alarm when an attached screw becomes loose. For example, this is disclosed in Japanese Patent No. 3032325.

This ceiling fan is described below with reference to FIG. 17. As shown in the drawing, pipe 101 passing through the center of ceiling fan is suspended from bracket 103 via semi-spherical flange 102. Bracket 103 is attached to mounting plate 105 by attaching screw 106. This mounting plate 105 is attached to a ceiling face by wood screw 104. Microswitch 107 is provided on bracket 103, and actuator 108 of microswitch 107 makes contact with the ceiling face.

To increase the safety, an alarming device is activated via microswitch 107 when wood screw 104 fixing mounting plate 105 or attaching screw 106 fixing bracket 103 is loosened in the conventional ceiling fan. However, if the shaft provided on the motor and the pipe suspending from the ceiling are connected by a connecting bolt via a through hole in this ceiling fan structure, the through hole for the connecting bolt may wear over time and the hole may broaden.

Japanese Utility Model Unexamined Publication No. S56-41115 discloses the next technology for a structure of an externally-rotating motor. A tubular portion is formed in the center of an upper case where an external rotor of the externally-rotating motor is embedded, and an upper ball bearing is press-fitted into this tubular portion. A vertical central shaft of an internal stator is inserted through this upper ball bearing, and a lower ball bearing, already press-fitted to the vertical central shaft, is inserted into the tubular portion in the center. A collar is provided between inner rings or outer rings of the upper and lower ball bearings, and a coil spring is provided between the other rings. The upper ball bearing is fixed to the tubular portion with an interference fit, and the lower ball bearing is fixed to the vertical central shaft with a clearance fit after the lower ball bearing is loosely fitted in the collar.

In this conventional motor, the outer ring of the upper ball bearing is fixed inside the tubular portion, which is a bearing housing, with the interference fit; and its inner ring is connected to the vertical central shaft with the clearance fit. The outer ring of the lower ball bearing is connected to the tubular portion with the clearance fit, and its inner ring and the vertical central shaft are connected with the interference fit. Accordingly, the weight of the rotor is applied in a direction that presses the outer ring of the upper ball bearing downward from a top end of the tubular portion. As deformation or deterioration of the coil spring advance in line with operations, a certain level of appropriate preload cannot be given to the upper and lower ball bearings, although an elastic member such as a coil spring is inserted between the upper and lower ball bearings. This causes distortion in a sliding face inside the upper and lower ball bearings at an early stage, resulting in the generation of a sliding noise. Reduction of this sliding noise has thus been demanded.

SUMMARY OF THE INVENTION

A ceiling fan of the present invention has the following structure. The ceiling fan has a motor that rotates multiple blades attached in the horizontal direction. This motor includes a hollow shaft disposed upright on the center of a disc-like stator, and a rotor around an outer periphery of the stator. The blades are attached to the rotor and the rotor rotates integrally with the blades. This motor further includes a cylindrical bearing housing provided over the stator, a rotor support integrally connecting this bearing housing and the rotor, and a pair of ball bearings, including an upper ball bearing and a lower ball bearing, housed in this bearing housing and rotatably supporting the rotor. This bearing housing has a base in its center. The upper ball bearing is disposed over this base via an elastic member, and the lower ball bearing is disposed below this base. The upper ball bearing and the lower ball bearing are fixed to the hollow shaft.

With this structure, shaking and vibration of the motor associated with the rotation of the bearing housing can be significantly reduced, and thus the present invention can offer the ceiling fan with low noise and low vibration. In addition, a pressing process of multiple operations become unnecessary. This can reduce damage to the ball bearing in an assembly process as well as a reduction in man-hours.

DETAILED DESCRIPTION OF PREFERRED EMBODIMENTS

Exemplary embodiments of the present invention are described below with reference to drawings.

First Exemplary Embodiment

Figure 1:
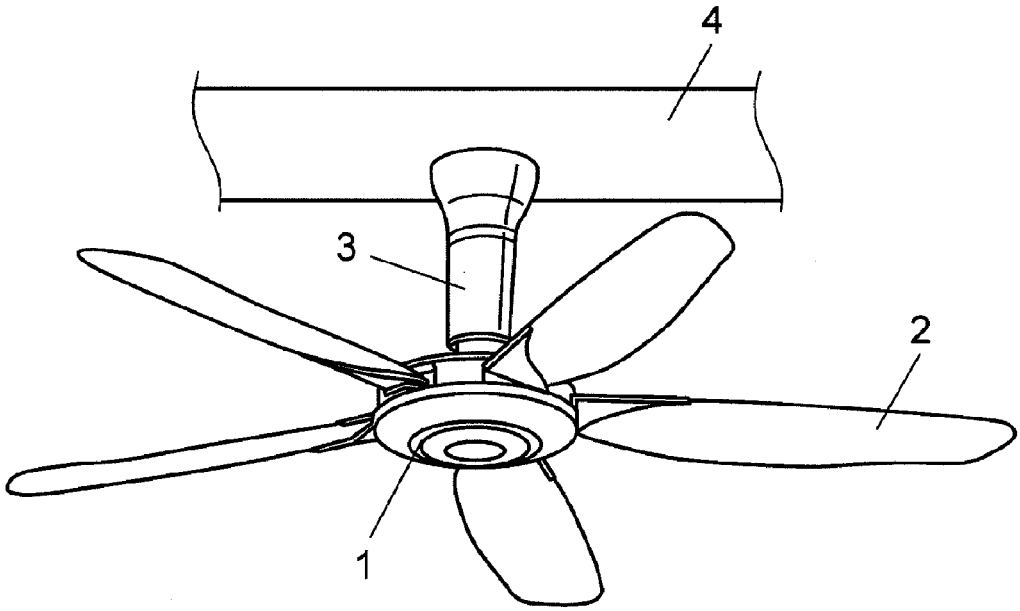
FIG. 1 illustrates a basic structure of a ceiling fan in accordance with a first exemplary embodiment of the present invention.

FIG. 1 illustrates a basic structure of a ceiling fan in the first exemplary embodiment of the present invention. The ceiling fan in the first exemplary embodiment includes motor 1 that rotates multiple blades 2 provided in the horizontal direction. This motor 1 is suspended from ceiling 4 using suspension mechanism 3.

Figure 2:
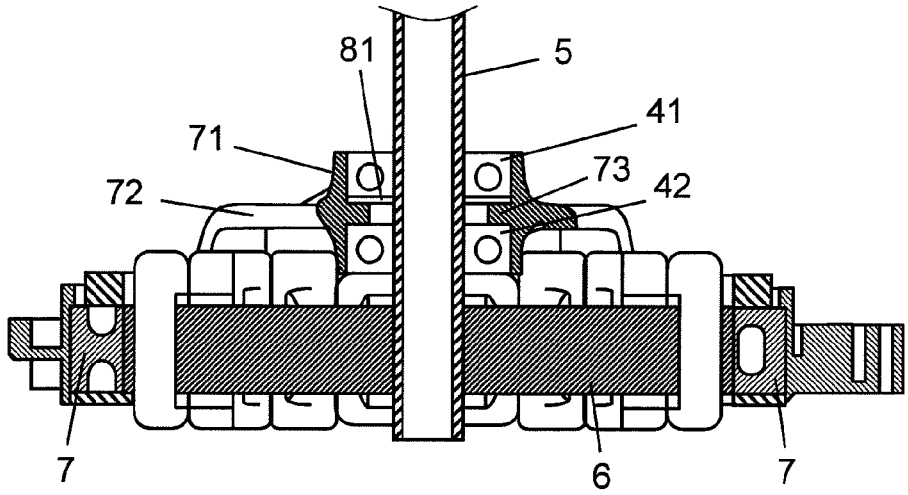
FIG. 2 is a sectional view of a motor of the ceiling fan in accordance with the first exemplary embodiment of the present invention.
Figure 3:
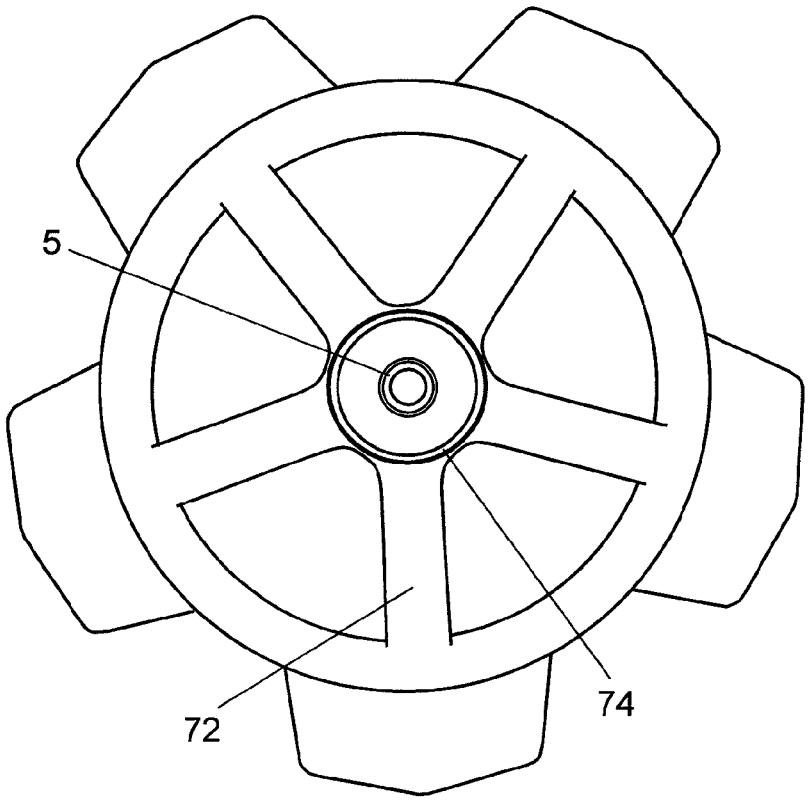
FIG. 3 is a top view of the motor in accordance with the first exemplary embodiment of the present invention.
Figure 4:
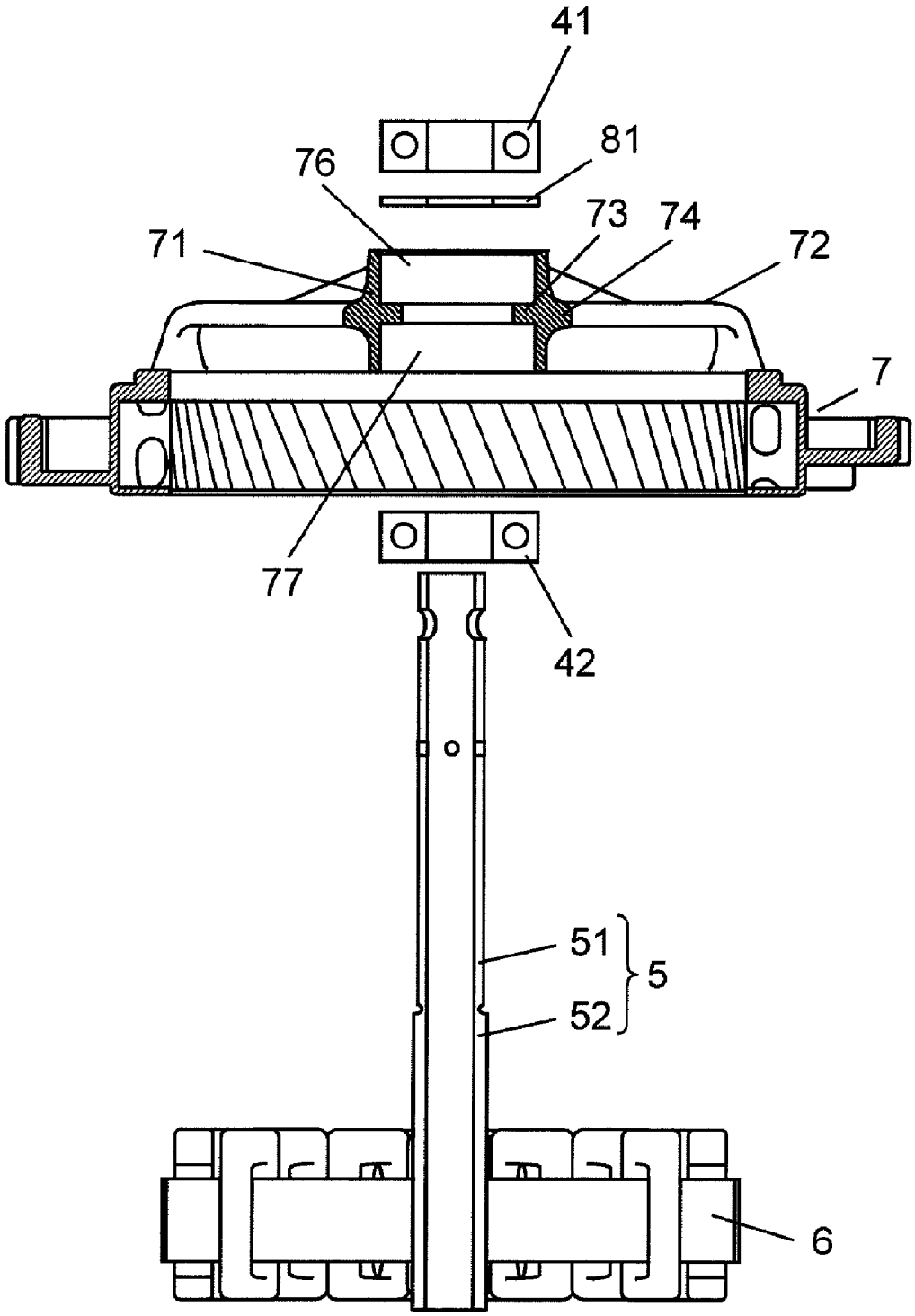
FIG. 4 is an exploded sectional view of the motor in accordance with the first exemplary embodiment of the present invention.
Figure 5:
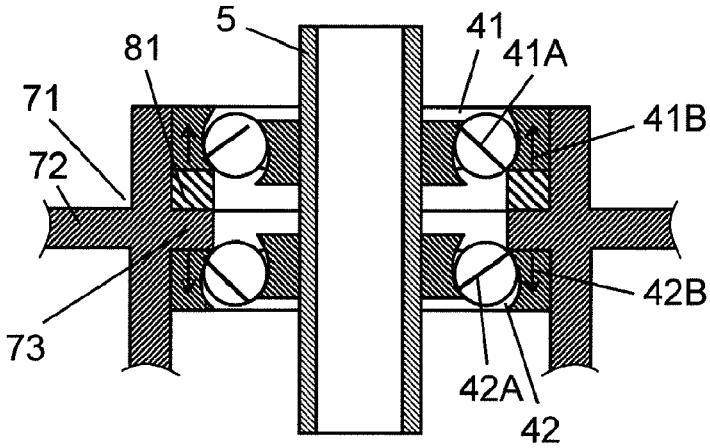
FIG. 5 is a schematic sectional view of a ball bearing in the motor in accordance with the first exemplary embodiment of the present invention.

FIG. 2 is a sectional view of motor 1 of the ceiling fan in the first exemplary embodiment of the present invention. FIG. 3 is its top view, and FIG. 4 is its exploded sectional view. FIG. 5 is a schematic sectional view of a ball bearing in motor 1.

Motor 1 includes disc-like stator 6 to which hollow shaft 5 is disposed upright on its center, and rotor 7 rotatably provided around the outer periphery of this stator 6. Blade 2 is attached to rotor 7. Motor 1 further includes cylindrical bearing housing 71, rotor support 72 that integrally connects this bearing housing 71 and rotor 7, and a pair of ball bearings including upper ball bearing 41 and lower ball bearing 42 housed in bearing housing 71 and rotatably supporting rotor 7. Bearing housing 71 includes base 73 in its center, upper ball bearing 41 disposed over this base 73 via upper elastic member 81, and lower ball bearing 42 disposed under base 73. An inner ring of upper ball bearing 41 and an inner ring of lower ball bearing 42 are both fixed to hollow shaft 5.

Bearing housing 71 has upper opening 76 at an upper part and lower opening 77 at a lower part relative to base 73 in the center. Upper ball bearing 41 is housed in upper opening 76, and lower ball bearing 42 is housed in lower opening 77 with a clearance fit, respectively. The inner ring of upper ball bearing 41 and the inner ring of lower ball bearing are fixed onto hollow shaft 5 with an interference fit.

In cylindrical bearing housing 71, base 73 in substantially the center and rotor support 72 are provided inside and outside of cylindrical bearing housing 71 so as to improve rigidity of bearing housing 71, and increase the holding power of upper ball bearing 41 and lower ball bearing 42.

In addition, provision of base 73 between both bearings in bearing housing 71 reduces a load applied to upper ball bearing 41 when the weight of rotor 7 is applied as a downward load to upper ball bearing 41 and lower ball bearing 42 via bearing housing 71, although the downward load is applied to the outer ring of lower ball bearing 42 from base 73. Since an upward pressing force acts on upper ball bearing 41 by the presence of upper elastic member 81, the upward load is applied. The total of the load on lower ball bearing 42 and upper ball bearing 41, and the upward pressing force acting on upper ball bearing 41 can greatly reduce the load applied to upper ball bearing 41 and lower ball bearing 42. This upper elastic member 81 is preferably a wave washer.

More specifically, as shown in FIG. 5, upper elastic member 81, such as a spring, can apply an upward pressing force to upper ball bearing 41, and the self-weight of lower ball bearing 42 and upper elastic member 81 can apply a downward pressing force to lower ball bearing 42. Balls in upper ball bearing 41 and lower ball bearing 42 are held by contact angles 41A and 42A in contradicting directions. With respect to preload directions 41B and 42B, an upward preload is applied to upper ball bearing 41 and downward preload is applied to lower ball bearing 42. This ensures application of substantially a fixed level of appropriate preload.

As described above, the load applied to upper ball bearing 41 and lower ball bearing 42 housed in bearing housing 71 can be reduced, and upper ball bearing 41 and lower ball bearing 42 can be firmly retained by improving the rigidity of bearing housing 71. Accordingly, shaking and vibration associated with the rotation of bearing housing 71 can be significantly reduced so as to stably rotate motor 1 with less shaking and vibration. The present invention can thus offer the ceiling fan with low noise and low vibration.

Upper ball bearing is fitted in from upper opening 76 of bearing housing 71, and lower ball bearing 42 is fitted in from lower opening 77. This enables assembly with increased dimensional accuracy, compared to an assembly method of fitting upper and lower ball bearings from the same direction. In addition, since upper ball bearing 41 and lower ball bearing 42 are fixed to hollow shaft 5 with the interference fit, a component (collar) needed for retaining a certain vertical distance at the inner ring side can be eliminated.

Hollow shaft 5 includes upper guiding part 51 and lower fitting part 52. The outside shape of guiding part 52 is smaller than that of fitting part 52.

An external diameter of this guiding part 51 is set such that it forms a clearance fit with an internal diameter of upper ball bearing 41 and lower ball bearing 42. Lower ball bearing 42, bearing housing 71 integrally provided with rotor 7, upper elastic member 81, and upper ball bearing 41 can be pressed and assembled onto hollow shaft 5, which is press-fitted to stator 6, by a single process. This eliminates multiple pressing processes. Accordingly, the required manpower can be reduced, and also damage to ball bearings during assembly can be reduced.

An upper end of cylindrical bearing housing 71, in which upper ball bearing 41 is housed, and an upper end of upper ball bearing 41 are made to be the same height. This enables visual confirmation of accurate housing of upper ball bearing with upper elastic member 81 in bearing housing 71. In addition, the pressing operation can be executed using the upper end of bearing housing 71 as a reference face. This facilitates the assembly operation and improves the assembly quality.

The bearing housing has a fulcrum on its outer periphery at the same height as the base. Fulcrum 74 of rotor supports 72 provided radially from bearing housing 71 is provided opposite to the side of base 73 of bearing housing 71. Therefore, rotor 7 can form a rotating body that rotates around the substantial center of upper ball bearing 41 and lower ball bearing 42 by matching fulcrum 74 extending from bearing housing 71 to the rear face of base 73. In other words, this rotating body rotates around a point that generates the least vibration on hollow shaft 5 sandwiched by upper ball bearing 41 and lower ball bearing 42. This results in less influence of shaking and vibration when motor 1 is operated, and achieves the structure that can retain uniform distance between stator 6 and rotor 7. Accordingly, electrical noise can be reduced.

Also, since rotor supports 72 extend horizontally from bearing housing 71, a rotating body in which rotor supports 72 extend horizontally from on bearing housing 71 in the center, can be achieved. Rotor supports 72 and base 73 thus become aligned in a cross-sectional shape. This facilitates retention of accuracy at manufacturing die-casting dies. This also allows the formation of die-cast parts in shapes whose dimensions are easy to inspect.

Figure 6:
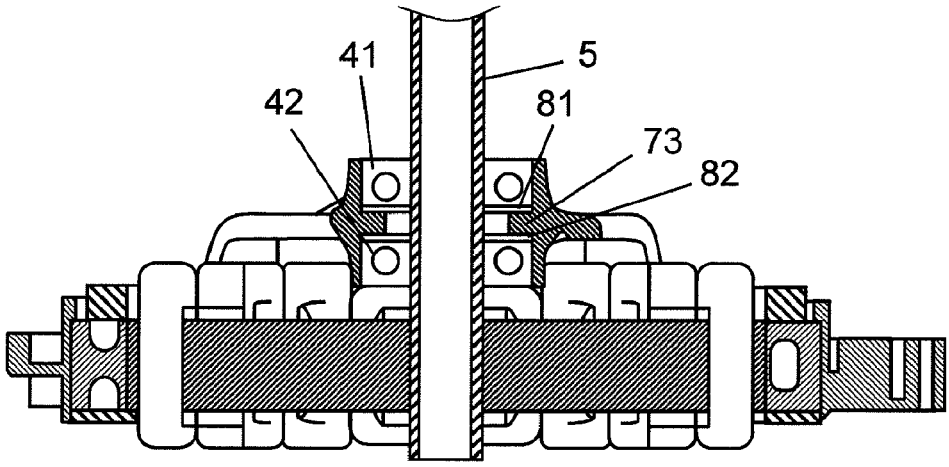
FIG. 6 is a sectional view of another motor in accordance with the first exemplary embodiment of the present invention.

FIG. 6 is a sectional view of another motor of the ceiling fan in this exemplary embodiment. Lower elastic member 82 is inserted between base 73 and lower ball bearing 42. Other components are the same as the structure shown in FIG. 2.

This structure prevents direct traveling of an impact to lower ball bearing 42 via base 73 and traveling of faint vibration of blades 2 to hollow shaft 5. In addition, lower ball bearing 42 can be protected from damage. A wave washer is preferable as this lower elastic member 82. With this structure, clearances among base 73, upper ball bearing 41, and lower ball bearing 42 can be set small, contributing to downsizing and slimming of motor 1.

Figure 7:
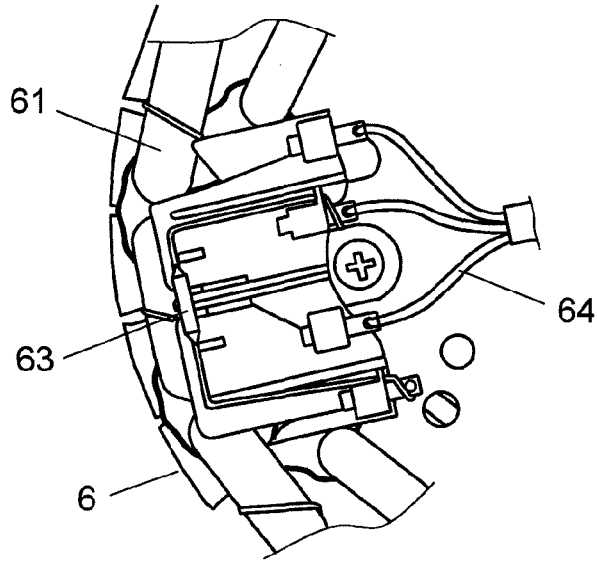
FIG. 7 is a fragmentary sectional view of still another motor in accordance with the first exemplary embodiment of the present invention.

FIG. 7 is a fragmentary sectional view of still another motor of the ceiling fan in this exemplary embodiment. Overtemperature protective device 63 for detecting a temperature of stator coil 61 is disposed on a bottom face of stator coil 61 of stator 6.

This structure enables connection of stator coil 61 and internal wiring 64 from overtemperature protective device 63 directly to a main body circuit without passing through hollow shaft 5. Accordingly, there is no need to draw wiring around, and thus measurement accuracy of detected temperature can be retained by preventing errors in detection data. Furthermore, manpower can be reduced by improving assembly operations. Furthermore, internal wiring 64 will not be damaged by touching typically an edge when hollow shaft 5 is passed through. This ensures reliable connection.

Figure 8:
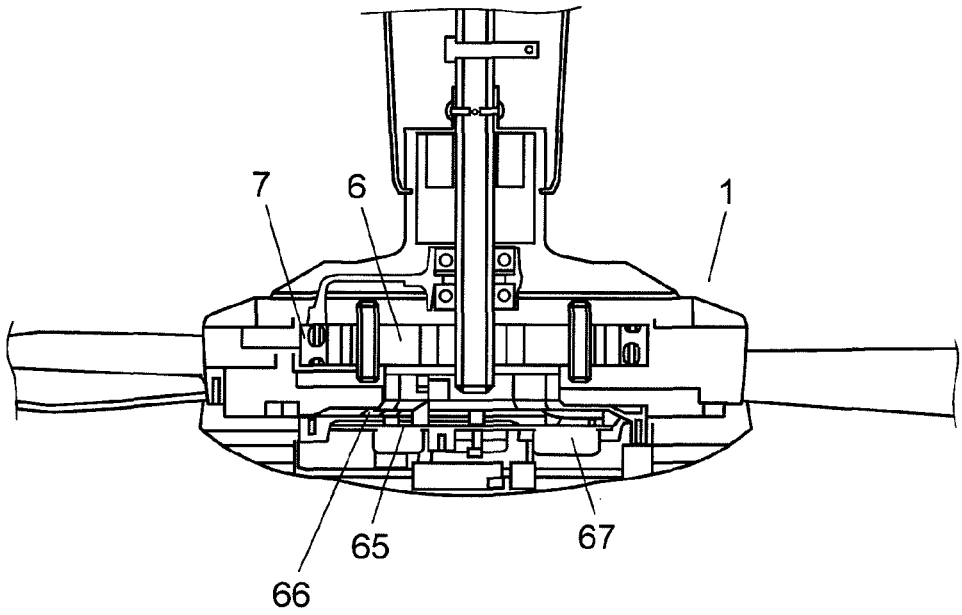
FIG. 8 is a sectional view of still another motor to which a horizontal detector is added in accordance with the first exemplary embodiment of the present invention.

FIG. 8 is a sectional view of still another motor of the ceiling fan in this exemplary embodiment. As shown in the drawing, circuit board 65 controlling motor 1 is disposed on board holder 66, and board holder 66 is directly attached to the bottom face of stator 6. Circuit board 65 or board holder 66 is disposed horizontally, and horizontal detector 67 that is set horizontal is provided on circuit board 65 or board holder 66.

With this structure, the present invention can offer the ceiling fan in which horizontal detector 67 detects an abnormal operation of motor 1 for any reason or any vibration due to earthquake, and safely stops the operation of motor 1. Further safety can be ensured by adding vibration sensor and revolution sensor to this horizontal detector 67.

Figure 9:
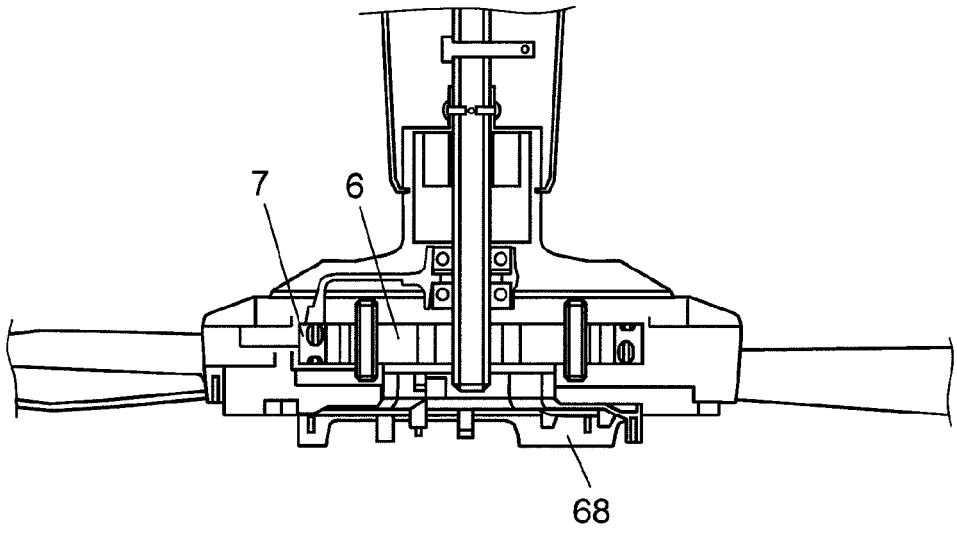
FIG. 9 is a sectional view of still another motor to which a light bracket is added in accordance with the first exemplary embodiment of the present invention.

FIG. 9 is a sectional view of still another motor of the ceiling fan in this exemplary embodiment. In FIG. 9, light bracket 68 is provided on the bottom face of stator 6 so that a lighting fixture can be attached immediately under and close to rotor 7. This structure ensures the suspension strength when a heavy lighting fixture is installed. In addition, the horizontal level can be retained in installation. Accordingly, the lighting fixture can be mounted immediately under and close to rotor 7. This enables the installation of a general thin lighting fixture with large diameter.

Figure 10:
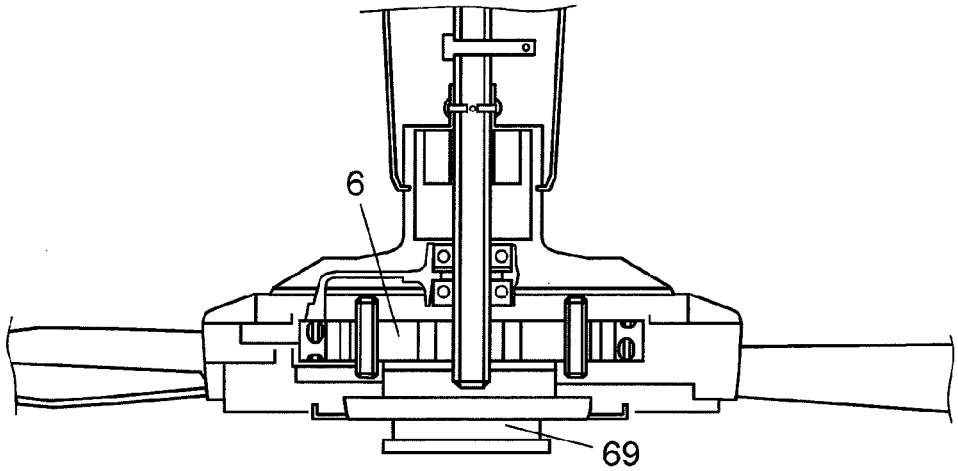
FIG. 10 is a sectional view of still another motor to which a hook rosette is attached in accordance with the first exemplary embodiment of the present invention.

FIG. 10 is a sectional view of yet another motor of the ceiling fan in this exemplary embodiment. In FIG. 10, hook rosette 69 to which a lighting fixture can be attached on the bottom face of stator 6 is provided. With this structure, a lighting fixture that is directly mountable to commercial hook rosette 69 can be installed. Accordingly, construction work for attaching the lighting fixture becomes easier, and greater variation in lighting fixtures becomes available.

Second Exemplary Embodiment

Figure 11:
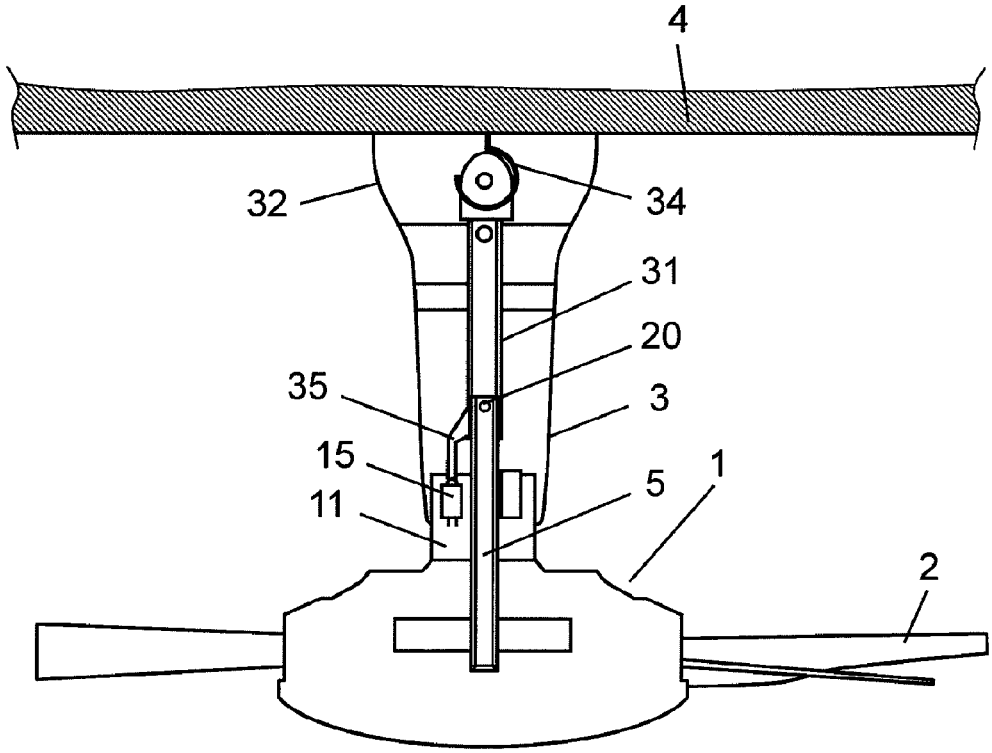
FIG. 11 is a sectional view of a suspension mechanism of a ceiling fan in accordance with a second exemplary embodiment of the present invention.
Figure 12:
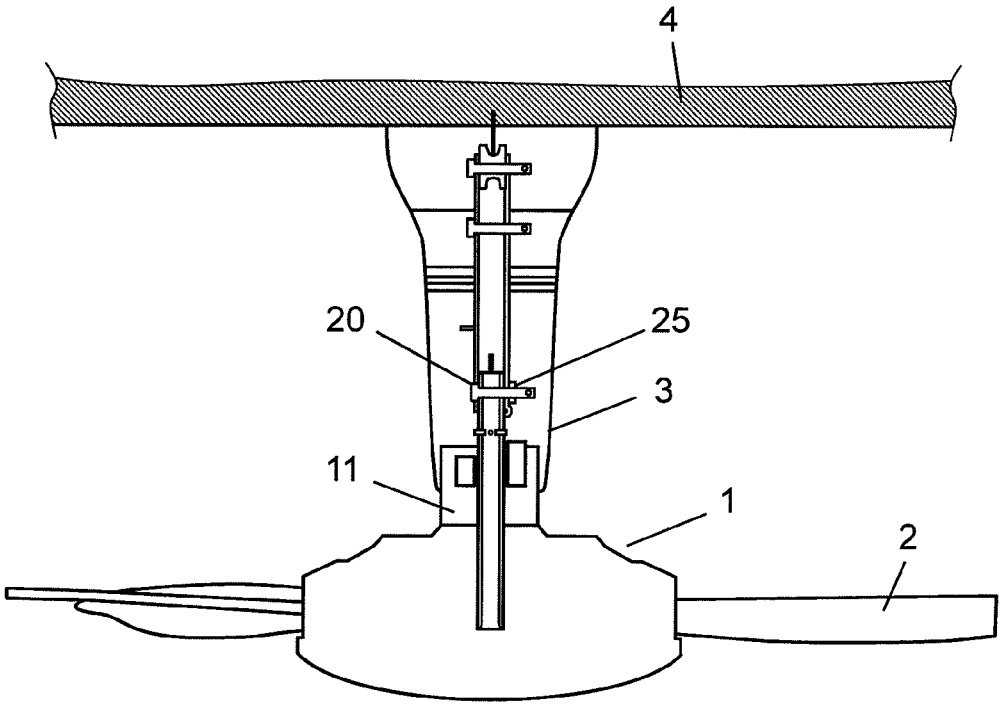
FIG. 12 is a sectional view of the suspension mechanism in accordance with the second exemplary embodiment of the present invention.
Figure 13:
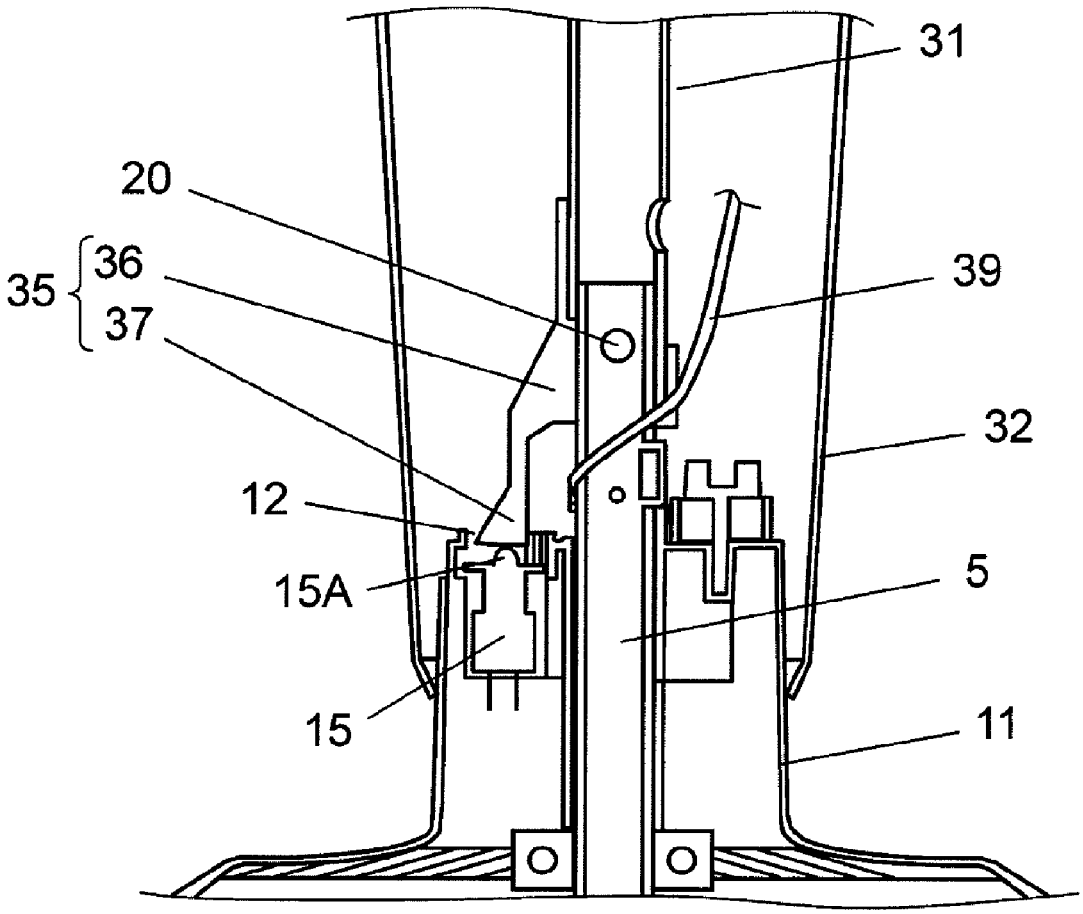
FIG. 13 is a magnified view of a key part of the suspension mechanism in accordance with the second exemplary embodiment of the present invention.

FIGS. 11 and 12 are fragmentary sectional views of a suspension mechanism of a ceiling fan in the second exemplary embodiment of the present invention. FIG. 13 is a magnified view of its key part. Suspension mechanism 3 includes pipe 31 connected to hollow shaft 5 of motor 1 by connecting bolt 20, operation lever 35 for operating safety switch 15, and suspender 34 for suspending pipe 31 from ceiling 4. Hollow shaft 5 and pipe 31 have through holes, respectively, through which they are connected by connecting bolt 20. Details are described later.

Motor cover 11 is provided on a top part of motor 1, and opening 12 is created on its top face. Safety switch 15 is fixed inside motor cover 11 to the side of hollow shaft 5. Operation lever 35 for operating this safety switch 15 includes fixing part 36 and arm 37 extending obliquely downward from this fixing part 36. Fixing part 36 is fixed to pipe 31, and arm 37 operates safety switch 15 through opening 12.

Safety switch 15 has operation button 15A, and this operation button 15A is disposed at a lower part of opening 12. As described above, arm 37 of operation lever 35 operates this operation button 15A. Safety switch 15 has a normally open contact, and safety switch 15 is installed in a state that this contact is closed by making arm 37 push operation button 15A. A circuit is configured such that electricity is provided to motor 1 through this contact. Accordingly, in normal use, the ceiling fan is connected to the main supply in a state that the contact of the safety switch is closed by operation lever 35, and thus motor 1 can be operated.

One end of safety wire 39 for preventing dropping is fixed onto ceiling 4, and a wire fixing part provided on the other end of safety wire 39 is fixed onto an outer peripheral face of hollow shaft 5 at the inner side of operation lever 35. Safety switch 15 provided on the side of hollow shaft 5, operation lever 35, and a joint portion of hollow shaft 5 and pipe 31 are entirely covered with canopy 32.

Figure 14:
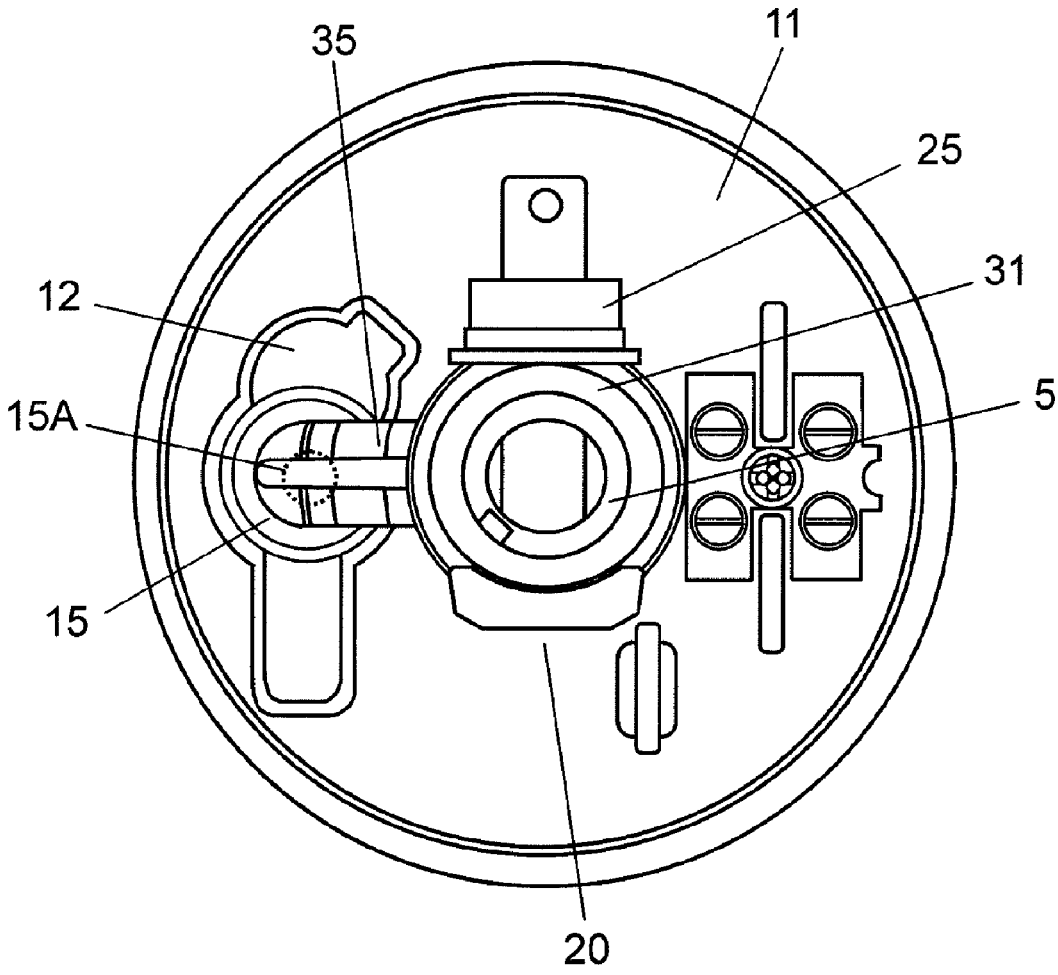
FIG. 14 is a top view illustrating the relationship between an opening and a safety switch in accordance with the second exemplary embodiment of the present invention.

FIG. 14 is a top view illustrating the relationship between opening 12 in motor cover 11 and safety switch 15 of the ceiling fan in the second exemplary embodiment. As shown in FIG. 14, an area of opening 12 is extended along the circumferential movement of arm 37 of operation lever 35 around hollow shaft 5.

Figure 15:
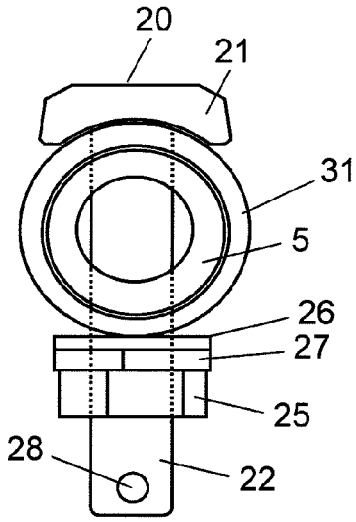
FIG. 15 is a sectional view illustrating the relationship between a connecting bolt and a pipe in accordance with the second exemplary embodiment of the present invention.
Figure 16:
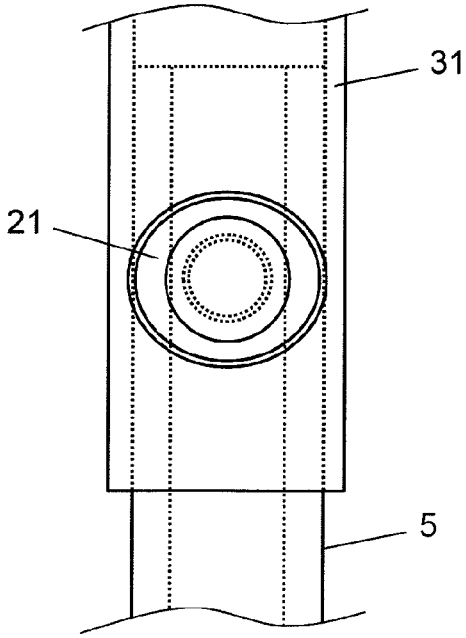
FIG. 16 is a front view illustrating a connecting bolt and a pipe in accordance with the second exemplary embodiment of the present invention.
Figure 17:
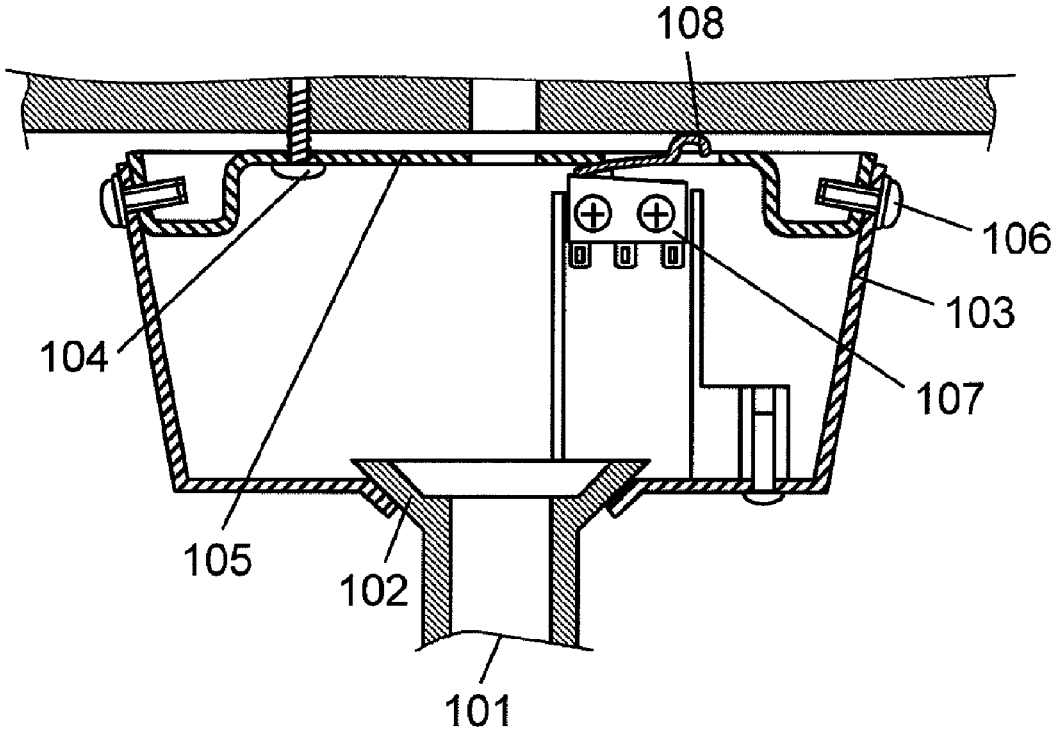
FIG. 17 illustrates a ceiling-suspended state of a conventional ceiling fan.

FIG. 15 is a sectional view illustrating the relationship between connecting bolt 20 and pipe 31 of the ceiling fan in the second exemplary embodiment. FIG. 16 is its front view. Connecting bolt 20 has head 21 and thread 22. A cross-section of this head 21 to the side of thread 22 is a circular arc conforming to the outer face of pipe 31. A shape of head 21 seen from the side opposite to thread 22, relative to pipe 31, is an oval.

Connecting bolt 20 is screwed to nut 25 via flat washer 26 and spring washer 27, and a pin (not illustrated) is inserted into pin-insert-hole 28 created in thread 22 so as to prevent nut 25 from coming off.

In this structure, an end of hollow shaft 5 is inserted into an end of pipe 31; and connecting bolt 20 is passed through each of the through holes in hollow shaft 5 and pipe 31, and tightened by screwing nut 25 in a manner such that a circular-arc portion of head 21 of connecting bolt 20 conforms to an outer peripheral face of pipe 31. This eliminates the need for supporting head 21 of connecting bolt 20, and thus a tightening tool, such as a spanner, is used only for nut 25. Installation work at a high place near the ceiling can thus be facilitated. In addition, since the circular-arc portion of head 21 of connecting bolt 20 is fixed tightly onto the outer peripheral face of pipe 31, rotation or loosening of connecting bolt 20 can be reliably prevented, increasing the safety.

Next, the safety operation at occurrence of some sort of abnormality is described. If tightening force of connecting bolt 22 that connects hollow shaft 5 and pipe 31 is insufficient, looseness occurs at the joint over time after repeated operation and stopping of the ceiling fan. Then, the through holes in hollow shaft 5 and pipe 31 wear and their hole diameters broaden. In this case, arm 37 of operation lever 35 deviates corresponding to a relative increase in a turn area of hollow shaft 5 and pipe 31, and the contact of safety switch 15 is opened. This stops current supplied to motor 1, and thus the unsafe state is immediately and automatically avoided. Furthermore, since the power will not turn on even if the power is turned on again, the user will be alerted of an abnormal state of the suspended main body.

An opening area of opening 12 in the top face of motor cover 1 is created along the circumferential direction in which operation lever 35 moves centered on hollow shaft 5 of motor 1. The turn area of hollow shaft 5 relative to pipe 31 increases as the hole diameters of the through holes of hollow shaft 5 and pipe 31 wear and broaden over time, and operation lever 35 moves into opening 12. Since operation lever 35 turns in the circumferential direction around pipe 31, the shape of opening 12 is also extended in the circumferential direction, so as to conform to the movement area of operation lever 35. Accordingly, safety switch 15 reliably works to stop power supply to motor 1 when there is imminent danger.

In addition, the top end of operation button 15A of safety switch 15 is provided at a position lower than the top face of opening 12 of motor cover 11. Therefore, it is difficult to forcibly push operation button 15A, typically with a finger, when operation lever 35 deviates and safety switch 15 is in the open state. Accordingly, restarting of the ceiling fan by intentionally operating operation button 15A after motor 1 is stopped, while the joint of hollow shaft 5 and pipe 31 remains unstable, is preventable.

Furthermore, the wire fixing part of safety wire 39 is fixed to the outer peripheral face of hollow shaft 5 at an inner side of operation lever 35. This wire fixing part thus cannot be removed unless operation lever 35 is removed. Fixing of this wire fixing part at the inner side of arm 37 of operation lever 35 before shipment from a factory prevents easy removal of safety wire 39 during installation of the main body. This encourages contractors to use safety wire 39 in their installation work.

The ceiling fan of the present invention achieves a low-noise and low-vibration motor, prevents danger of dropping of the ceiling fan and abnormal vibrations, and facilitates installation. Accordingly, this ceiling fan is suitable for installation in plants, offices, hotels, and houses.

The invention claimed is:

1. A ceiling fan comprising:
a motor that rotates a plurality of blades horizontally disposed; and
a suspension mechanism for suspending the motor from a ceiling;
wherein the motor includes
a disc-like stator,
a hollow shaft disposed upright on a center of the disc-like stator so as to protrude upward from the motor,
a rotor around an outer periphery of the stator, the rotor being integrally rotated with the blades attached to the rotor;
a cylindrical bearing housing provided over the stator,
a rotor support integrally connecting the bearing housing and the rotor,
a pair of ball bearings, including an upper ball bearing and a lower ball bearing housed in the bearing housing and rotatably supporting the rotor, and
a safety switch that opens and closes a supply of electricity to the stator,
wherein the bearing housing includes a base in its center, the upper ball bearing is disposed over the base via an elastic member, the lower ball bearing is disposed under the base, and the upper ball bearing and the lower ball bearing are fixed onto the hollow shaft; and
wherein the suspension mechanism includes
a pipe connected to the hollow shaft for suspending the motor from the ceiling,
a connecting bolt for connecting the hollow shaft and the pipe, and
an operation lever for opening and closing the safety switch, the operation lever being moved in response to a relative turn of the hollow shaft and the pipe so as to open a contact of the safety switch.

2. A ceiling fan comprising:
a motor that rotates a plurality of blades horizontally disposed; and
a suspension mechanism for suspending the motor from a ceiling;
wherein the motor includes
a hollow shaft protruding upward from the motor,
a stator fixed to the hollow shaft,
a safety switch that opens and closes a supply of electricity to the stator; and
wherein the suspension mechanism includes
a pipe connected to the hollow shaft for suspending the motor from the ceiling,
a connecting bolt for connecting the hollow shaft and the pipe, and
an operation lever for opening and closing the safety switch, the operation lever being moved in response to a relative turn of the hollow shaft and the pipe so as to open a contact of the safety switch.

3. The ceiling fan of claim 2,
wherein the hollow shaft and the pipe have through holes, respectively, through which the connecting bolt passes, and a contact of the safety switch is opened when a hole diameter of the through holes broadens.

4. The ceiling fan of claim 2,
wherein the motor includes a motor cover having an opening, the safety switch is disposed inside the motor cover, and the safety switch is operated by the operation lever through the opening.

5. The ceiling fan of claim 4,
wherein the opening is provided in a top face of the motor cover in a circular arc shape around the hollow shaft.

6. The ceiling fan of claim 4,
wherein the safety switch includes an operation button, the operation button being disposed at a lower part of the opening.

7. The ceiling fan of claim 4,
wherein the operation lever includes a fixing part and an arm, the fixing part being fixed to the pipe, and the safety switch being operated by the arm through the opening.

8. The ceiling fan of claim 2,
wherein the suspension mechanism includes a safety wire for preventing dropping, one end of the safety wire being configured to be fixed onto the ceiling, and another end of the safety wire being fixed onto the hollow shaft at an inner side of the operation lever.

9. The ceiling fan of claim 2,
wherein the connecting bolt includes a head and a thread, a cross-section of the head to a side of the thread being a circular arc conforming to an outer periphery of the pipe.

10. The ceiling fan of claim 9,
wherein a shape of the head seen from a side opposite to the thread is an oval.

11. The ceiling fan of claim 9,
wherein the thread includes a pin-insert-hole for inserting a pin so as to prevent a nut from coming off.

* * * * *